US005088557A

United States Patent [19]

Ricles et al.

[11] Patent Number: 5,088,557

[45] Date of Patent: Feb. 18, 1992

[54] DOWNHOLE PRESSURE ATTENUATION APPARATUS

[75] Inventors: Thomas D. Ricles, Kingwood; John A. Barton, Houston, both of Tex.

[73] Assignee: Dresser Industries, Inc., Dallas, Tex.

[21] Appl. No.: 494,096

[22] Filed: Mar. 15, 1990

[51] Int. Cl.[5] ..... E21B 43/117

[52] U.S. Cl. ..... 166/297; 166/55.1; 175/4.54

[58] Field of Search ..... 166/55.1, 297, 317; 175/4.56, 4.54, 4.59

[56] References Cited

U.S. PATENT DOCUMENTS

| | | | |
|---|---|---|---|
| 2,120,615 | 6/1938 | King | 164/0.5 |
| 2,155,322 | 4/1939 | McCullough | 175/4.56 |
| 2,419,371 | 4/1947 | Schlumberger | 102/20 |
| 2,873,675 | 2/1959 | Lebourg | 102/20 |
| 3,001,584 | 9/1961 | Scott | 166/63 |
| 3,163,112 | 12/1964 | Rhea | 166/297 X |
| 3,311,178 | 3/1967 | McElheny | 175/4.54 |
| 3,422,760 | 1/1969 | Mohaupt | 102/21.6 |
| 3,528,511 | 9/1970 | Boop et al. | 166/55.1 X |
| 3,710,717 | 1/1973 | Tamplen | 102/20 |
| 3,871,448 | 3/1975 | Vann et al. | 166/128 |
| 3,931,855 | 1/1976 | Vann et al. | 166/128 |
| 3,978,921 | 9/1976 | Ross | 166/57 |
| 4,040,482 | 8/1977 | Vann | 166/255 |
| 4,151,880 | 5/1979 | Vann | 166/314 |
| 4,299,287 | 11/1981 | Vann et al. | 166/297 |
| 4,330,039 | 5/1982 | Vann et al. | 166/297 |
| 4,491,185 | 1/1985 | McClure | 175/4.56 |
| 4,512,406 | 4/1985 | Vann et al. | 166/55.1 X |
| 4,515,217 | 5/1985 | Stout | 166/297 |
| 4,529,038 | 7/1985 | Brieger | 166/312 |
| 4,576,233 | 3/1986 | George | 166/297 |
| 4,616,701 | 10/1986 | Stout et al. | 166/55.1 |
| 4,657,089 | 4/1987 | Stout | 166/297 X |
| 4,664,184 | 5/1987 | Grigar | 166/55.1 |
| 4,693,314 | 9/1987 | Wesson et al. | 166/317 |
| 4,693,317 | 9/1987 | Edwards et al. | 166/55.1 X |
| 4,732,211 | 3/1988 | Haugen et al. | 166/55.1 |
| 4,790,385 | 12/1988 | McClure et al. | 166/299 |
| 4,800,958 | 1/1989 | Haugen et al. | 166/55.1 |

*Primary Examiner*—Hoang C. Dang

[57] ABSTRACT

A downhole pressure attenuation apparatus is provided by which the explosive and hydraulic peak pressure and quasi-static pressure pulses generated by perforating gun detonation are attenuated by one or more fluid-free chambers having initially closed vent ports which are opened substantially contemporaneous with gun detonation so as to provide one or more free volume, pressure absorbing cavities. The pressure attenuation apparatus is made up of at least one fluid-free chamber and one or more pressure relief vents. Each pressure relief vent includes at least one charge port assembly having a prestressed port and an explosive filled shaped charge. The number of charge port assemblies used in each vent is determined by the surface area to be opened and the size of the vent chamber. Each of the charge port assemblies of the relief vent is operatively connected to a common explosive filled, detonating cord which forms part of the perforating gun detonating cord, or an extension thereof depending on the location of the pressure attenuating apparatus with respect to the perforating gun or guns. As the detonating cord fires, it causes each of the charge ports to sequentially fire and blow out the prestressed area of each port so as to open one or more vent holes leading to the vent chamber. The amount of explosive in each of the shaped charges of the charge ports is limited so that the detonation of the charge ports in the relief vent does not damage surrounding tubular bodies in the well.

22 Claims, 2 Drawing Sheets

DOWNHOLE PRESSURE ATTENUATION APPARATUS

BACKGROUND OF THE INVENTION

This invention generally relates to downhole explosive devices and, more particularly, it concerns a downhole pressure attenuation device for use with perforating guns.

Conventional downhole explosive devices, such as, wireline or tubing conveyed perforating guns are employed during the completion of oil and gas wells to perforate the well casings and adjacent formations and in so doing bring the wells into production. In particular, a perforating gun having a plurality of spaced charges is lowered into a well bore in which a casing or screen has already been installed. The perforating gun is run downhole until the gun is located adjacent to the desired formation. A packer is set above the perforating gun and, then, the gun is detonated to create holes in the casing and surrounding formations and, thereby, release formation fluids or gasses into the well bore.

Typically, perforating guns forming part of a tool string are lowered into the well or casing using either a wireline or a tubing string. An example of a wireline or cable conveyed perforating gun and method is described in U.S. Pat. No. 2,155,322 issued to I. J. McCullough on Apr. 18, 1939. Tubing conveyed perforating guns and methods are described, for example, in U.S. Pat. Nos. 4,491,185 issued to G. B. McClure on Jan. 1, 1985, 4,512,406 issued to R. R. Vann et al on Apr. 23, 1985, and 4,790,385 issued to G. B. McClure et al on Dec. 13, 1988.

Tubing conveyed perforating guns and methods enjoy many advantages over wireline conveyed perforating guns. One advantage of using a tubing string to convey or lower the perforating gun into the well bore is that immediately after the perforating gun is detonated the well can be brought into production using the same tubing string used to convey the perforating gun as the conduit for bringing formation fluids to the surface.

Another advantage of using a tubing conveyed perforating gun system is that prior to detonation of the perforating gun the well bore can be cleaned or flushed of fluids and debris and trapped bottom hole pressures below the packer can be vented using tubing string vents located between the packer and the perforating gun. As described in above-mentioned U.S. Pat. Nos. 4,491,185, 4,512,406, and 4,790,385, the well bore is vented by opening a plurality of fluid vents, for example, in a perforated nipple or sub before the detonation of the perforating gun or guns to allow the well bore fluids to enter the tubing annulus and be removed at the surface.

Although the above-mentioned fluid vents in conventional tubing conveyed perforating gun systems do facilitate the flushing and/or venting of at least some well bore fluids prior to gun detonation, there is also a need for a pressure attenuation apparatus which can absorb, control, and/or reduce the peak pressure wave or quasi-static pressure pulse produced by downhole perforating gun detonation. The pressure pulses produced by downhole explosive device detonation have been known to unseat downhole packer plugs, damage seals, damage both mechanical and electrical downhole instrumentation, and collapse tubing, casings, and other downhole assemblies. Conventional, substantially mechanical tool string shock absorbers such as described, for example, in U.S. Pat. No. 4,693,317 issued to A. G. Edwards et al on Sept. 15, 1987, provide only a modicum of tool string protection from the enormous pressures and/or shock waves produced by downhole, perforating gun detonation.

In light of the foregoing, there is a need for a downhole device which can effectively attenuate the extreme pressures produced by the detonation of one or more perforating guns.

SUMMARY OF THE INVENTION

In accordance with the present invention, a downhole pressure attenuation apparatus is provided by which the explosive and hydraulic peak pressure pulses generated by perforating gun detonation are attenuated by one or more fluid-free chambers having initially closed vent ports which are opened substantially contemporaneous with gun detonation so as to provide one or more free volume, pressure absorbing cavities.

In the practice of the present invention, the pressure attenuation apparatus is made up of at least one fluid-free chamber and one or more pressure relief vents. Each pressure relief vent includes at least one charge port assembly having a prestressed port and an explosive filled shaped charge. The number of charge port assemblies used in each vent is determined by the surface area to be opened and the size of the vent chamber.

Each of the charge port assemblies of the relief vent is operatively connected to a common explosive filled, detonating cord which forms part of the perforating gun detonating cord, or an extension thereof depending on the location of the pressure attenuating apparatus with respect to the perforating gun or guns. As the detonating cord fires, it causes each of the charge ports to sequentially fire. The pressure produced by each separate charge port firing is sufficient to blow out the prestressed area of the port and, thereby, leave an about 0.75 inch diameter vent hole leading to the vent chamber. The amount of explosive in each of the shaped charges of the charge ports is limited so that the detonation of the charge ports in the relief vent does not damage surrounding tubular bodies in the well.

The high speed at which the detonating cord fires, for example, 27,000 feet per second, ensures that the relief vent or vents and the perforating gun or guns fire substantially instantaneously. Thus, the relief vent is opened and the free volume of the vent chamber is exposed to accept the quasi-static high pressures resulting from perforating gun detonation and for surging of the perforated formations immediately following perforation.

Among the objects of the present invention are, therefore, the provision of a pressure attenuation apparatus and method for use with downhole perforating guns and which attenuates peak pressure pulses and quasi-static high pressures generated by perforation gun detonation to prevent damage to downhole equipment while at the same time surging geologic formation perforations to provide for increased formation fluid or gas recovery. Another object of the invention is to provide such a method and apparatus by which the pressure attenuation apparatus includes relief vents and chambers which are adapted for use with existing downhole tubing strings and equipment. Other objects and further scope of applicability of the present invention will become apparent from the detailed description to follow taken in conjunction with the accompanying drawings in which like parts are designated by like reference numerals.

DETAILED DESCRIPTION OF THE PREFERRED EMBODIMENTS

Figure 1:
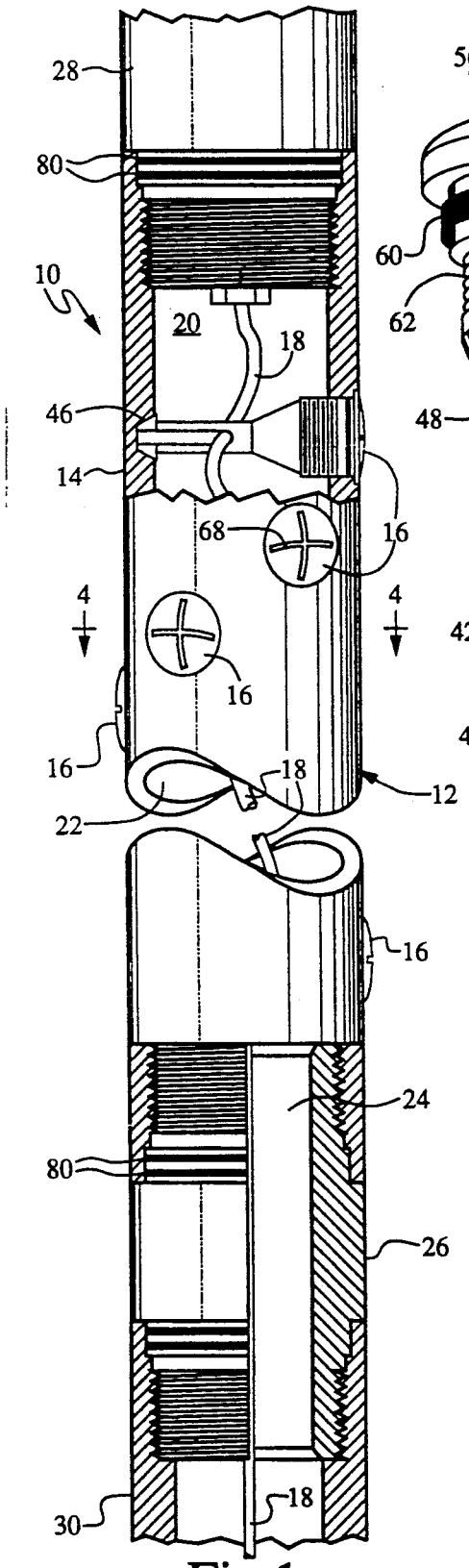
FIG. 1 is a fragmentary cross section illustrating an exemplary embodiment of the pressure attenuation apparatus of the present invention.
Figure 4:
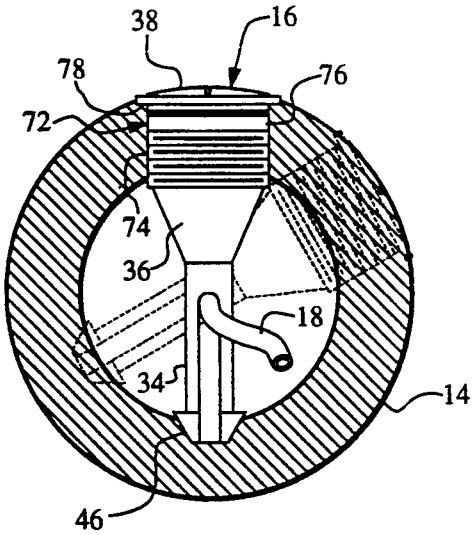
FIG. 4 is a cross section of the pressure attenuation apparatus of FIG. 1 taken along line 4—4.

In FIGS. 1 and 4 of the drawings, the pressure attenuation apparatus of the present invention is generally designated by the reference numeral 10 and shown to include a relief vent 12 including a section of tubing 14 supporting a plurality of charge port assemblies 16 operatively connected by a common detonating cord 18. The pressure attenuation apparatus 0 further includes a vent chamber 20 including the free space 22 within the tubing 14 and the free space 4 within a hollow sub 26. The size of the vent chamber 20 can be enlarged by adding a section of tubing below the hollow sub 26.

Figure 5:
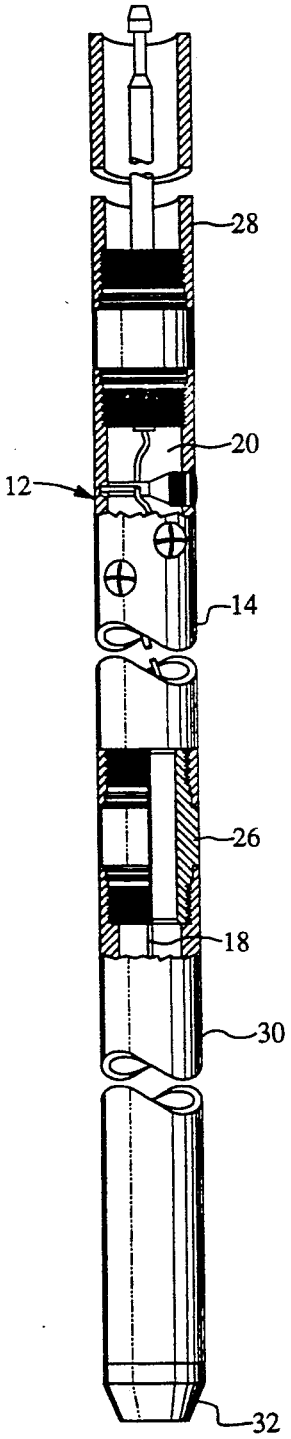
FIG. 5 is a fragmentary cross section and perspective view of the pressure attenuation apparatus of the present invention in a perforating gun tubing string; an FIG. 6 is a fragmentary cross section and perspective view illustrating a plurality of pressure attenuating apparatus of the present invention placed above, below and between the perforating guns in a tubing string.

As shown in FIG. 5 of the drawings, the pressure attenuation apparatus 10 of the present invention is adapted to be located between a firing sleeve 28 and a perforating gun 30 which form part of a tubing string ending with a bull plug 32.

Figure 6:
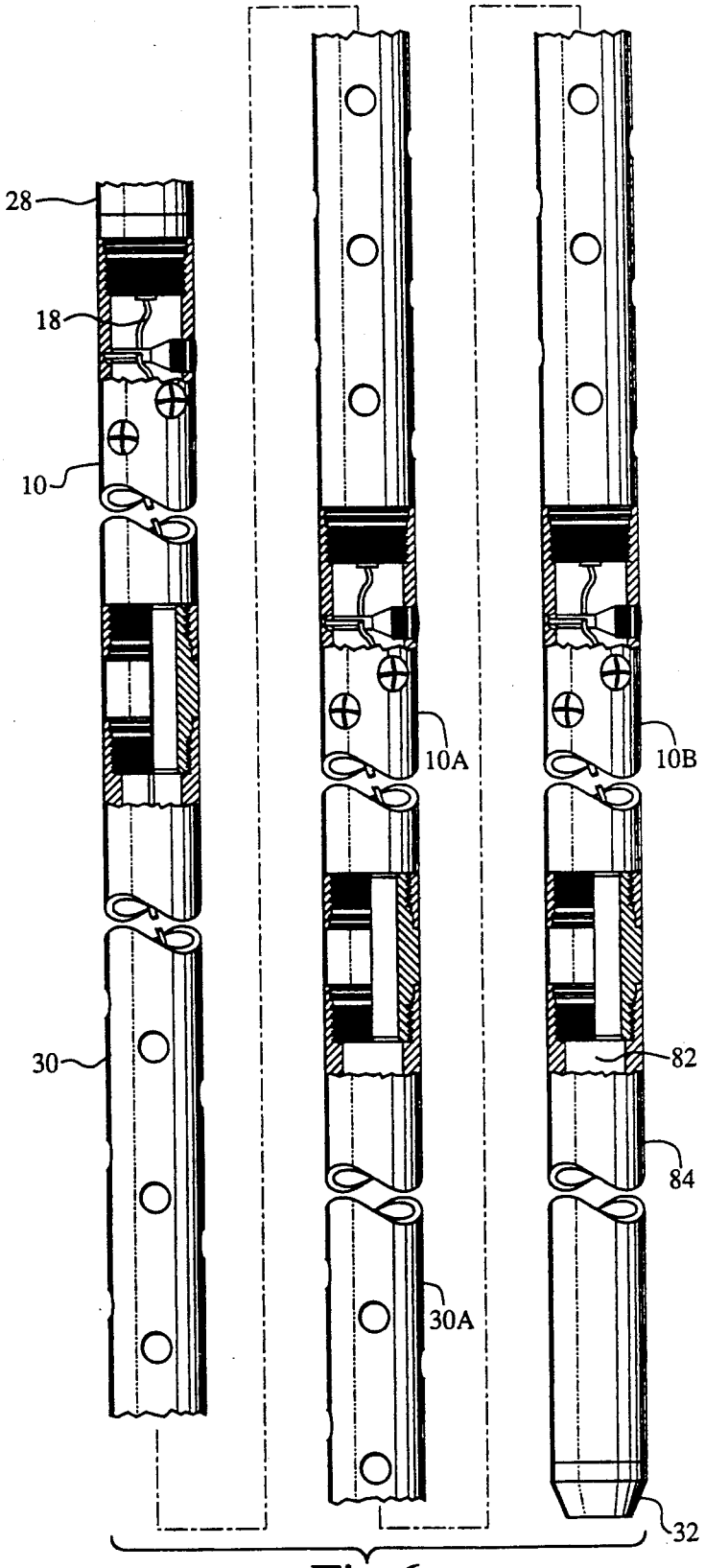

The detonating cord 18 not only operatively contacts each of the charge port assemblies 16, but also continues on through the hollow sub 26 to the perforating gun 30 as shown in FIG. 5 or on to a plurality of perforating guns 30 and 30A and additional pressure attenuating apparatus 10A and 10B as shown in FIG. 6.

Figure 2:
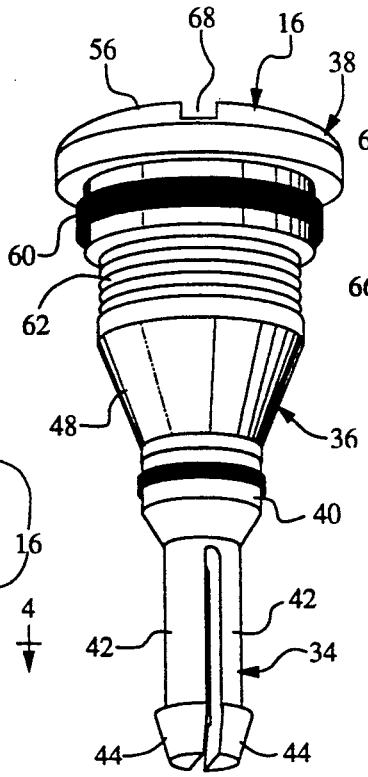
FIG. 2 is an enlarged perspective view representing the of the charge port assemblies of FIG. 1.
Figure 3:
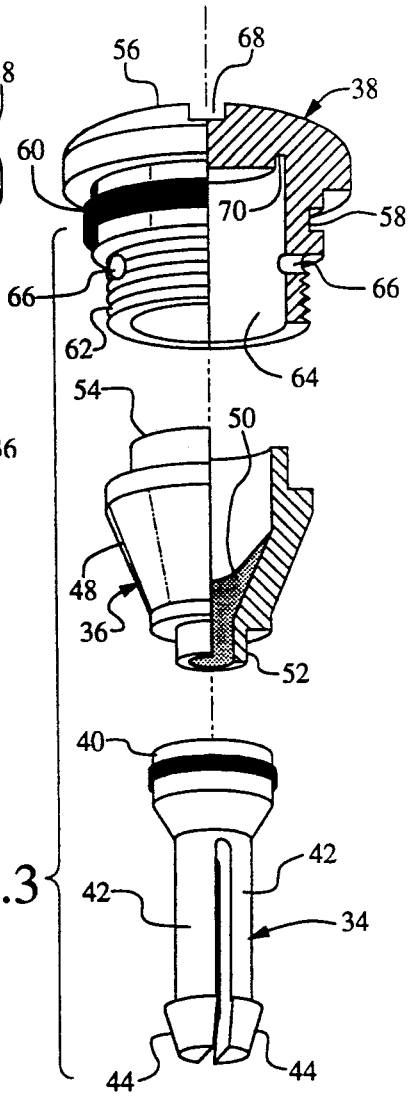
FIG. 3 is an exploded perspective view of the charge port assembly of FIG. 2.

With reference to FIGS. 2 and 3 of the drawings, an exemplary charge port assembly 16 is shown to include a support clip 34, a shaped charge 36, and a port member 38. The support clip 34 has a circular end 0 adapted to telescopically receive one end of the shaped charge 36, an opposing pair of resilient legs 42 designed to trap and position the detonating cord 18 adjacent the shaped charge 36 for proper charge initiation, and enlarged ends 44 on each of the legs 42 which rest within a respective recess 46 in the inner surface of the tubing 14 (FIGS. 1 and 4).

The shaped charge 36 includes a casing 48 and an explosive charge fill 50. The casing 48 has a small diameter circular flange 52 which is telescopically received within a corresponding opening in the cylindrical end 40 of the support clip 34. The casing 48 also has a large diameter circular flange 54 which is telescopically received within the port member 38.

The port member 38 has a prestressed, machined rupture disc 56, a circumferential groove 58, a resilient o-ring 60 received within the groove 58, helical threads 62, a central cylindrical bore 64, and a pair of opposing, small side openings 66. The rupture disc or cap 56 is prestressed in that the exterior surface has cross cut grooves 68 and the interior surface has a circular groove 70 which defines the circular portion of the disc 56 which will be blown off by the explosive charge 50.

As shown most clearly in FIG. 4 of the drawings, each of the port members 38 is received within a correspondingly shaped opening 72 in the tubing 14. Each of the openings 72 extends through the wall of the tubing 14 and includes a threaded portion 74 which receives the port member helical threads 62, a cylindrical portion 76 which provides a smooth sealing surface opposite the port member o-ring 60, and an enlarged recess 78 which receives the rupture disc 56. Note that the o-rings 60 on each of the charge port assemblies 16 and pairs of tubing o-rings 80 at each end of the tubing 14 provide a fluid tight seal for the vent chamber 20.

The number of charge port assemblies 16 is determined by the desired square inch area to be exposed and the size of the vent chamber 20. In accordance with an exemplary embodiment, the charge port assemblies are located with a one inch axial (vertical) distance between the center of adjacent rupture caps 56, a 60° displacement between adjacent assemblies 16 (FIG. 4), the total number of charge ports is equal to 1.5 times the inch squared area of the vent chamber 20, and the prestress groove 70 in the rupture cap 56 defines an about 0.75 inch diameter port or opening following detonation of the charge fill 50.

The amount of explosive fill 50 in each of the charge casings 48 is selected so as to be sufficient to cause the prestressed area of the disc 56 to be blown out without causing damage to adjacent tubular bodies in the oil or gas well. In accordance with an exemplary embodiment of the present invention, the explosive fill is RDX, HMX, HNS, or PYX type explosive depending on the desired temperature range.

With reference again to FIG. 6 of the drawings, an exemplary tool string is shown to include the firing head or sleeve 28, a plurality of pressure attenuating apparatus 10, 10A and 10B a pair of perforating guns 30 and 30A, an additional vent chamber 82 provided by a section of tubing 84, and the bull plug 32. The detonating cord 18 starts at the firing sleeve 28 and continues through each of the pressure attenuating apparatus and perforating guns so that when the cord 18 is fired the pressure relief vent of the attentuating apparatus 10 opens prior to detonation of the perforating gun 30, the relief vent of the apparatus 10A opens prior to detonation of the perforating gun 30A, and the relief vent of the apparatus 10B opens following detonation of both perforating guns 30 and 30A.

Since the pressure attentuation apparatus 10 of the present invention is assembled above ground with the other components of the tool string (i.e., firing sleeve, perforating gun, bull plug), the pressure within the vent chamber 20 is substantially atmospheric pressure and as such as a pressure which is below typical downhole pressures. Hence, opening of the relief vent 12, that its, detonation of the charge port assemblies 16, exposes the downhole fluid and pressures to a fluid-free, reduced pressure cavity 20 which serves to attenuate downhole pressures and surges perforations.

Thus, it will be appreciated that as a result of the present invention a highly effective pressure attenuation apparatus and method is provided by which the principal object and others are completely fulfilled. It is contemplated and will be apparent to those skilled in the art for the foregoing description and accompanying drawing illustrations that variations and/or modifications of the disclosed embodiment may be made without departure from the invention. Accordingly, it is expressly intended that the foregoing description and accompanying drawings are illustrative of a preferred embodiment only, not limiting, and that the true spirit and scope of the present invention be determined by reference to the appended claims.

What is claimed is:

1. A pressure attenuation apparatus for attenuating the peak pressure wave and quasi-static pressure pulse produced by downhole explosive devices in a well comprising:

a relief vent including tubing means supporting initially closed port means, and a vent chamber defined by said tubing mean and providing a free volume for attenuating downhole pressures when said port means of said relief vent is opened, wherein said port means of said relief vent comprises a plurality of charge port assemblies each including an explosive filled shaped charge and a prestressed rupture disc, the amount of explosive in each shaped charge being sufficient to rupture its associated disc without damaging surrounding tubular bodies in the well, and wherein said relief vent further comprises a detonating cord operatively connected to said shaped charge of each of said charge port assemblies.

2. The pressure attentuation apparatus of claim 1, wherein said vent chamber is at substantially atmospheric pressure prior to the opening of said port means.

3. The pressure attenuation apparatus of claim 1, wherein said relief vent is adapted to be connected to a tubing string.

4. The pressure attenuation apparatus of claim 1, wherein said relief vent is adapted to be connected to a perforating gun.

5. The pressure attenuation apparatus of claim 1, wherein said tubing means comprises a section of tubing.

6. The pressure attenuation apparatus of claim 1, wherein said tubing means of said relief vent further includes a hollow sub member adapted for connecting said relief vent to a length of tubing.

7. The pressure attenuation apparatus of claim 1, wherein said tubing means of said relief vent includes a hollow sub member adapted for connecting said relief vent to a perforating gun.

8. The pressure attenuation apparatus of claim 1, wherein said relief vent further includes an additional length of tubing.

9. The pressure attenuation apparatus of claim 8, wherein one end of said length of tubing is connected to said relief vent by a hollow sub member.

10. The pressure attentuation apparatus of claim 9, wherein the other end of said tubing is closed off by a bull plug.

11. The pressure attentuation apparatus of claim 1, wherein said apparatus is adapted for placement in a tubing string adjacent a perforating gun.

12. The pressure attenuation apparatus of claim 1, wherein said relief vent is adapted to be connected to a gun string.

13. The pressure attenuation apparatus of claim 1, wherein said tubing means of said relief vent includes a hollow sub member adapted for connecting said relief vent to a gun string.

14. The pressure attenuation apparatus of claim 1, wherein said apparatus is adapted for placement in a tubing string between two perforating guns.

15. In a perforating gun tool string including a firing sleeve and a perforating gun for use in a well, the improvement comprising at least one pressure attenuating apparatus interposed in said tool string for attenuating the peak pressure wave and quasi-static pressure pulse produced by perforating gun detonation, said pressure attenuating apparatus including a relief vent and a vent chamber providing a free column for attenuating downhole pressures upon the opening of said relief vent; wherein said relief vent comprises tubing means supporting a plurality of charge port assemblies each including a prestressed rupture disc and an explosive filled shaped charge, the amount of explosive in each shaped charge being sufficient to rupture its associated disc without damaging surrounding tubular bodies in the well, and wherein said relief vent further comprises a detonating cord operatively connected to said shaped charge of each of said charge port assemblies and wherein said vent chamber is defined by said tubing means.

16. The tool string of claim 15, wherein said pressure attenuation apparatus is located below the perforating gun.

17. The tool string of claim 15, wherein said pressure attenuation apparatus is located above the perforating gun.

18. The tool string of claim 15 wherein said at least one pressure attenuation apparatus comprises a plurality of pressure attenuation apparatus each of which is located adjacent a perforating gun.

19. A process for preventing damage to tool strings and other downhole equipment in a well caused by pressures produced during detonation of one or more downhole explosive devices, comprising the steps of:

adding to a tool string at least one pressure attenuating apparatus for attenuating the peak pressure wave and quasi-static pressure pulse produced by said explosive devices, said pressure attenuating apparatus including an initially closed relief vent including tubing means supporting a plurality of charge port assemblies each including an explosive filled shaped charge and a prestressed disc, said shaped charges interconnected by a detonating cord, the amount of explosive in each shaped charge being sufficient to rupture its associated disc without damaging surrounding tubular bodies in the well, and a vent chamber defined by said tubing means and providing a liquid free volume, and opening said relief vent substantially contemporaneously with downhole explosive device detonation by detonating the shaped charges to rupture said discs of said charge port assemblies.

20. A process for surging perforated formations in oil or gas wells at high differential pressures, comprising the steps of:

providing downhole at least one pressure attenuation apparatus for attenuating the peak pressure wave and quasi-static pressure pulse produced by downhole explosive devices, said pressure attenuation apparatus including an initially closed relief vent including tubing means supporting a plurality of charge port assemblies each including an explosive filled shaped charge and a prestressed disc, said shaped charges interconnected by a detonating cord, the amount of explosive in each shaped charge being sufficient to rupture its associated discs without damaging surrounding tubular bodies in the well, and a vent chamber defined by said tubing means and providing a liquid free volume at substantially atmospheric pressure, and opening said relief vent to expose the downhole fluids to the interior of said vent chamber by detonating said shaped charges to rupture said discs of said charge port assemblies.

21. In a process for perforating a well to bring the well into production using a tool string having one or more perforating guns, the improvement comprising the steps of:

adding at least one pressure attenuation apparatus for attenuating the peak pressure wave and quasi-static pressure pulse produced by said perforating guns, said pressure attenuation apparatus including an initially closed relief vent including tubing means supporting a plurality of charge port assemblies each including an explosive filled shaped charge and a prestressed rupture disc, said shaped charges interconnected by a detonating cord, the amount of explosive in each shaped charge being sufficient to rupture its associated disc without damaging surrounding tubular bodies in the well, and a vent chamber defined by said tubing means to said tool string adjacent one of said perforating guns, and opening said relief vent to expose the down hole fluids and gases to the interior of said vent chamber by detonating the shaped charges to rupture said discs of said charge port assemblies.

22. The process of claim 21 wherein said vent chamber is initially maintained at substantially atmospheric pressure and defines therein a liquid free volume.

* * * * *